US009316074B2

(12) United States Patent
O'Brien

(10) Patent No.: US 9,316,074 B2
(45) Date of Patent: Apr. 19, 2016

(54) RESETTABLE SELECTIVE LOCKING DEVICE

(71) Applicant: Baker Hughes Incorporated, Houston, TX (US)

(72) Inventor: Robert S. O'Brien, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 546 days.

(21) Appl. No.: 13/685,839

(22) Filed: Nov. 27, 2012

(65) Prior Publication Data

US 2014/0144619 A1 May 29, 2014

(51) Int. Cl.
*E21B 23/02* (2006.01)
*E21B 17/02* (2006.01)
*E21B 23/00* (2006.01)

(52) U.S. Cl.
CPC ..... *E21B 23/02* (2013.01); *E21B 17/02* (2013.01); *E21B 23/004* (2013.01)

(58) Field of Classification Search
CPC ..... E21B 23/004; E21B 23/006; E21B 23/02; E21B 17/02
USPC ..... 166/240, 242.6, 237
See application file for complete search history.

(56) References Cited

U.S. PATENT DOCUMENTS

| | | | | |
|---|---|---|---|---|
| 5,133,404 | A * | 7/1992 | Dollison | 166/72 |
| 5,826,657 | A | 10/1998 | Ringgenberg | |
| 6,382,319 | B1 * | 5/2002 | Hill et al. | 166/278 |
| 6,464,006 | B2 * | 10/2002 | Womble | 166/276 |
| 6,634,424 | B2 | 10/2003 | Knowles | |
| RE41,759 | E | 9/2010 | Helms | |
| 7,828,064 | B2 | 11/2010 | Robichaux et al. | |
| 8,118,102 | B2 | 2/2012 | Robichaux et al. | |
| 2003/0173089 | A1 | 9/2003 | Westgard et al. | |
| 2003/0183396 | A1 * | 10/2003 | Adams et al. | 166/382 |
| 2005/0051337 | A1 * | 3/2005 | Jennings et al. | 166/348 |
| 2009/0065214 | A1 | 3/2009 | Purkis | |
| 2010/0307767 | A1 * | 12/2010 | Fay et al. | 166/382 |
| 2011/0114325 | A1 | 5/2011 | Coghill et al. | |
| 2011/0147007 | A1 * | 6/2011 | O'Malley et al. | 166/373 |
| 2011/0209867 | A1 | 9/2011 | Nevels et al. | |

* cited by examiner

*Primary Examiner* — Robert E Fuller
*Assistant Examiner* — Christopher Sebesta
(74) *Attorney, Agent, or Firm* — Steve Rosenblatt

(57) ABSTRACT

A lock system works in combination with a mandrel to allow selective operation and disabling of a downhole tool. In the specific situation of a Smart Collet® the tool is locked from being able to find support when engaged to a mating profile as the tool is moved between landing locations. A lower housing features an external dog that in response to rotation takes with it a collet ring with circumferentially oriented fingers. An outer housing cams the collet heads into a respective groove in the mandrel. Reversal of such relative rotation between the upper and lower housings allows the collet heads to spring out of the mandrel groove for the unlocked position. The lock is adapted for use in a variety of tools. The rotation to unlock and then lock is accomplished by dog interaction with shaped internal profiles in a surrounding tubular assembly at strategic locations where needed.

18 Claims, 7 Drawing Sheets

RESETTABLE SELECTIVE LOCKING DEVICE

FIELD OF THE INVENTION

The field of the invention is a selectively operated lock for a downhole tool and more particularly a selective lock for a Smart® Collet when used in multiple zone completions.

BACKGROUND OF THE INVENTION

The details of the assembly and operation of Smart® Collets is described in detail in U.S. Pat. Nos. 6,382,319 and 6,464,006. In essence the collet lands at predetermined support locations in an outer screen assembly and is part of an inner string. For example, in U.S. Pat. No. 6,382,319 FIG. 1 the support locations are 36, 37 and 38 and their spacing is known as a single zone is being treated. However in multiple zone completions the spacing of the support locations intended to operate with the Smart® Collet may be unknown or the large spacing between zones with the potential of other tools being in the assembly that present potential unintended support locations for the Smart® Collet present problems to surface personnel in determining if the inner string assembly in a gravel pack is properly aligned so that gravel delivered through the frac port in the inner string will properly cross over to the outer annular space of the zone that needs the gravel packing. What is needed as provided by the present invention is a way to selectively prevent the Smart® Collet from supporting any load until it comes in proximity of the shoulder on which it is intended that it will support a load. At this point the lock is defeated to allow the Smart® Collet to function normally for proper crossover support at the desired zone to selectively circulate or squeeze or reverse out in the known manner as described in the aforementioned patents. While the preferred application will be described as being for a Smart® Collet in a multi-zone gravel packing operation, those skilled in the art will appreciate that there are broader applications for locks that selectively unlock and reset to respectively unlock and lock an associated tool for multiple operations at spaced subterranean locations.

Sleeves have been used for location and orientation of keys to insure that a given collet system only latches at a desired profile location as described in US Publication 2003/0173089 A1. In a different application a protective sleeve reduces the drift diameter to protect a release sleeve from catching a hold of the release sleeve inadvertently and moving it. A release tool is inserted through the release sleeve and into the protective sleeve inside diameter. The protective sleeve has an inner spline for the release tool to be able to get past the release sleeve and get a grip on the release sleeve to shift it. This device is described in U.S. application Ser. No. 13/142,552.

Downhole swivels involve a locking and unlocking feature for selective tandem or relative rotation of components that is accomplished with longitudinal component shifting to selectively engage a second pair of splines to another set of splines that are already meshed using a common shaft. Swivels of this type are shown in U.S. Pat. No. RE41,759 and in a different application in U.S. Pat. Nos. 7,828,064 and 8,118,102.

What is needed and provided by the present invention is a simple lock and unlock feature for a subterranean tool that is located on a string delivering the tool that selectively allows the tool to operate as intended at predetermined locations and then locks the tool against operating as the tool is moved away from the desired location of operation. These and other aspects of the present invention will be more readily apparent to those skilled in the art from a review of the description of the preferred embodiment and the associated drawings while recognizing that the full scope of the invention is to be determined by the appended claims.

SUMMARY OF THE INVENTION

A lock system works in combination with a mandrel to allow selective operation and disabling of a downhole tool. In the specific situation of a Smart® Collet the tool is locked from being able to find support when engaged to a mating profile as the tool is moved between landing locations. A lower housing features an external dog that in response to rotation takes with it a collet ring with circumferentially oriented fingers. An outer housing cams the collet heads into a respective groove in the mandrel. Reversal of such relative rotation between the upper and lower housings allows the collet heads to spring out of the mandrel groove for the unlocked position. The lock is adapted for use in a variety of tools. The rotation to unlock and then lock is accomplished by dog interaction with shaped internal profiles in a surrounding tubular assembly at strategic locations where needed.

DETAILED DESCRIPTION OF THE PREFERRED EMBODIMENT

Figure 1:
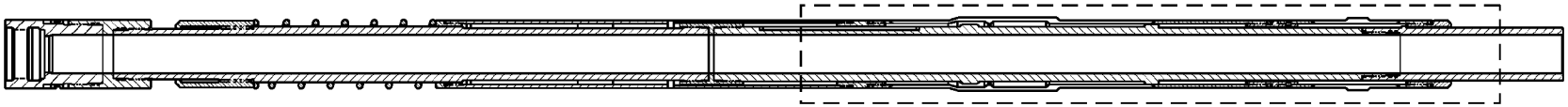
FIG. 1 is a section view of a known Smart® Collet with the selective lock feature shown at the right end.
Figure 2:
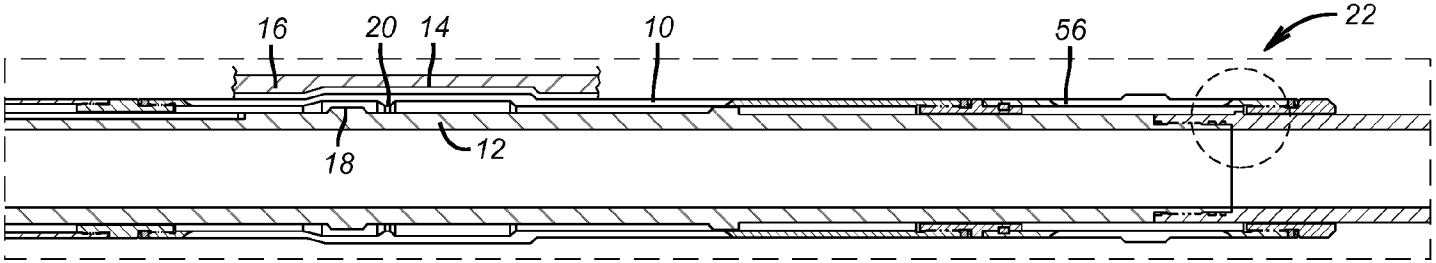
FIG. 2 is an enlarged view of the lock feature at the right end of FIG. 1.

Referring to FIG. 1 the Smart® Collet 10 is of a type known in the art and described in detail in U.S. Pat. Nos. 6,382,319 and 6,464,006. In operation, greatly simplified, the collet assembly is a movable member 10 that moves radially and relatively axially with respect to the mandrel 12 so that the collet assembly 10 can snap into profile 14 in the surrounding tubular 16. Once there is such engagement the mandrel 12 can be axially manipulated with respect to the collet assembly 10 now supported in profile 14. This relative axial motion can place support 18 in line with inner ring 20 on the collet assembly 10 to lock the collet assembly 10 in the profile 14. There are generally several such profiles 14 in spaced locations for a given zone to gravel pack to support the circulate, squeeze and reverse out positions of the crossover (not shown) that supports the collet assembly 10 through the mandrel 12 support 18 misaligned with ring 20 to then allow the collet assembly 10 to radially collapse and move out of the profile 14. The lock assembly 22 is supported by mandrel 12 and is designed to selectively permit or prevent relative axial movement between the mandrel 12 and the collet assembly 10. In the locked position the support 18 is held offset to ring 20 so that the collet assembly 10 cannot find support in any profile such as 14. When lock assembly 22 is released, the collet assembly 10 works as a known Smart® Collet.

Figure 3:
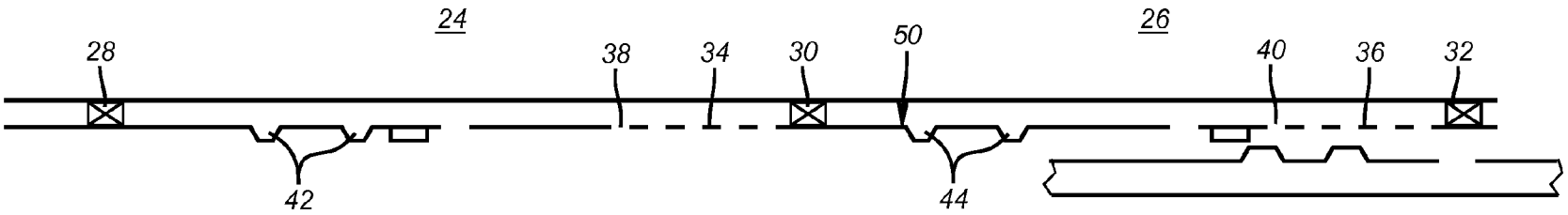
FIG. 3 shows a two zone gravel packing application of the lock system of the present invention with the Smart® Collet in the locked position.
Figure 4:
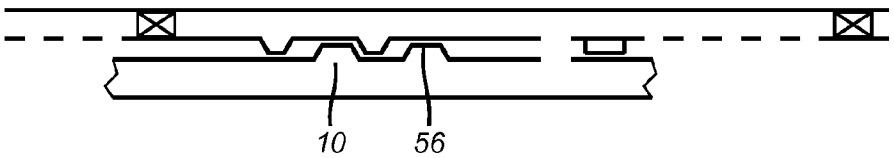
FIG. 4 is the view of FIG. 3 with the Smart® Collet unlocked and supporting a crossover in a profile so that the frac port aligns with the port above the screens to the outer annulus of the lower zone.

An assembly for two zones 24 and 26 is illustrated in FIG. 3. Zone 24 is between packers 28 and 30 and zone 26 is between packers 30 and 32. Screens 34 are in zone 24 and screens 36 are in zone 26. The screens 34 and 36 respectively have openings 38 and 40 above to allow gravel slurry or other fluids to pass into the outer annulus in the borehole that reaches the zones 24 and 26 by going through the outer assembly 50. The collet assembly 10 engages profile 42 in zone 24 or profile 44 in zone 26 in a known manner. FIG. 3 shows profile 46 for example in section and FIG. 4 shows the inside view showing the adjacent and alternating peaks 52 and valleys 54. Preferably there is a constant pitch to the pattern. The patterns at profiles 46 and 48 can be identical or the pitch on one can be the reverse of the pitch on the other.

Figure 5:
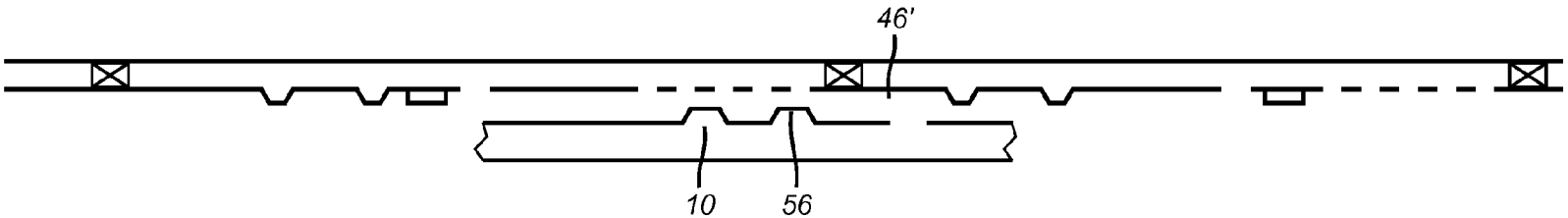
FIG. 5 is the view of FIG. 4 after the lower zone is completed with the Smart® Collet locked for movement to the next zone uphole.

When relative axial movement is permitted between the mandrel 12 and the collet assembly 10 it allows normal Smart® Collet operation in zone 24 just as the collet assembly 10 comes into the vicinity of the support locations 42 in zone 24. This normal operation is shown illustratively in FIG. 4 for the lower zone 26 which would normally be treated first. The same process occurs in zone 24. FIG. 5 shows the inner string of mandrel 12, collet assembly 10 and lock assembly 22 moving sufficiently to lock the Smart® Collet until zone 24 is reached.

Figure 6:
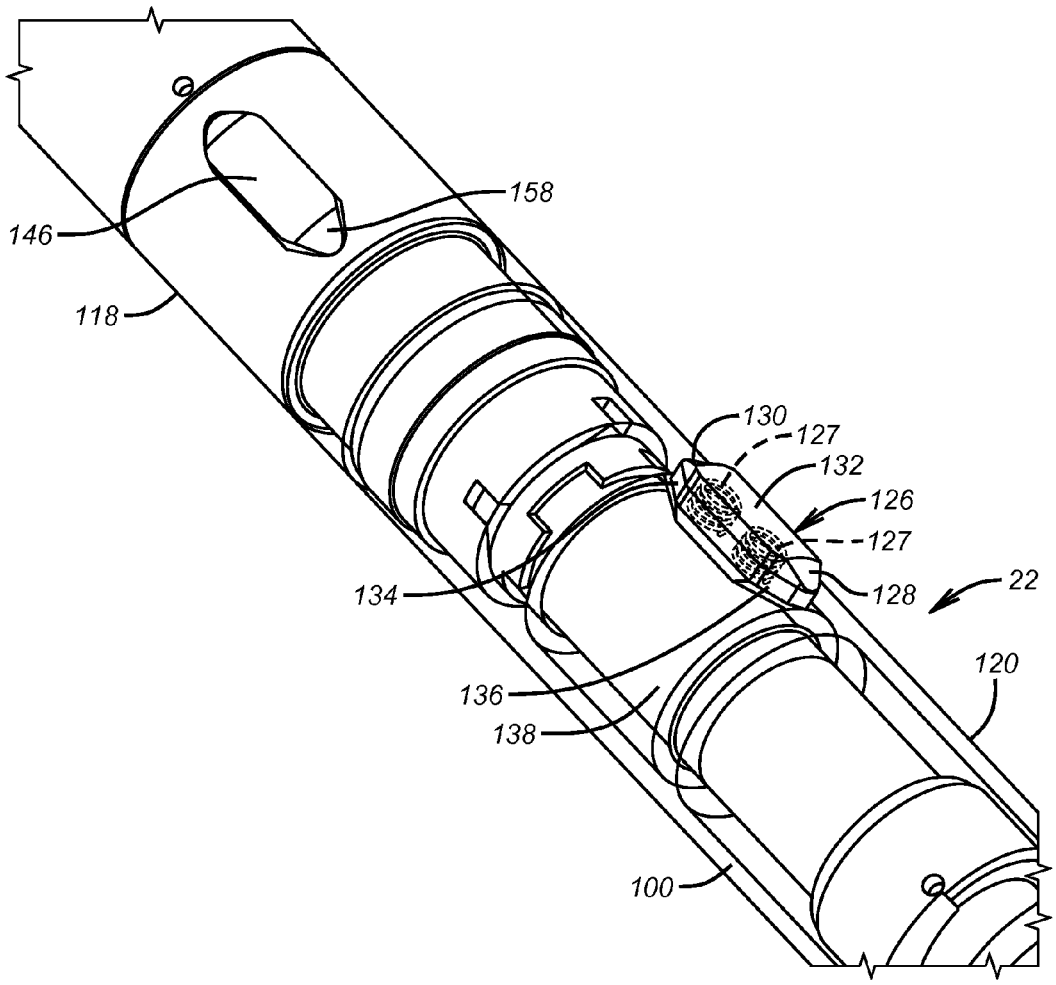
FIG. 6 is a perspective view of the upper housing seen through the lower lousing.
Figure 7:
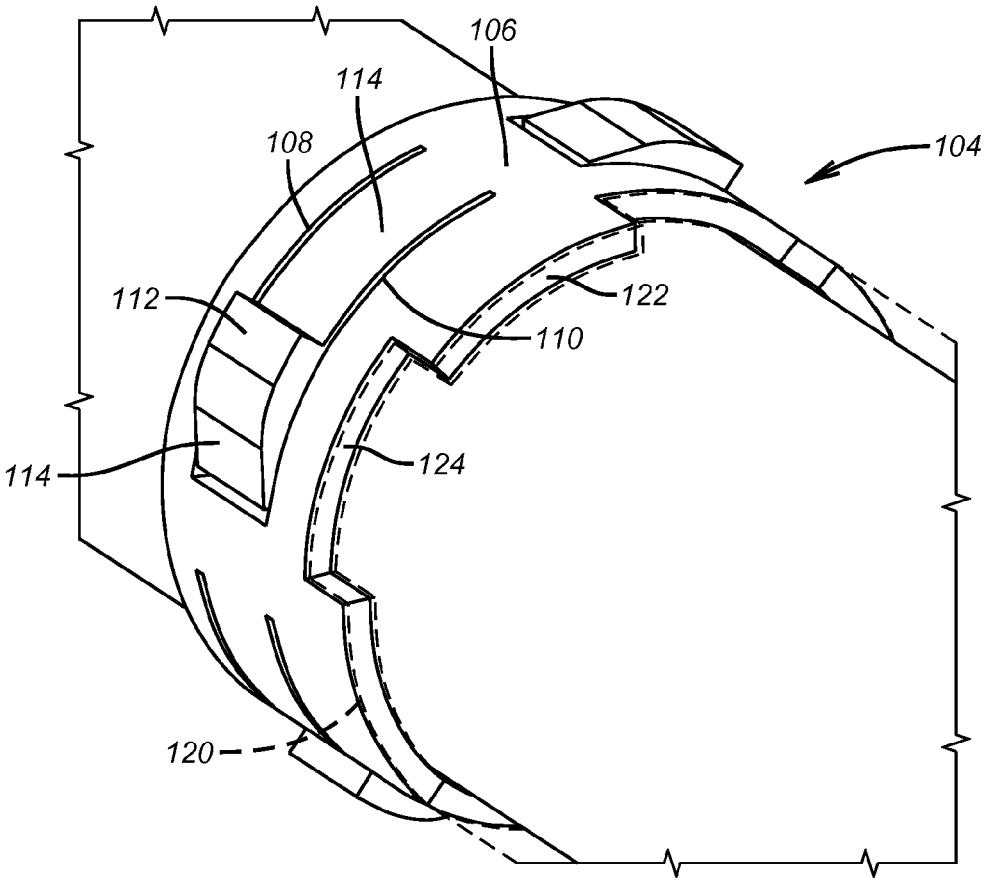
FIG. 7 is a perspective view of the collet type lock ring.

The lock assembly 22 serves to permit or prevent the support 18 to align with the ring 20 so that the Smart® Collet 10 selectively enabled to latch into a given profile or just snaps in and right back out due to the inability of support 18 to get aligned with ring 20. It is this relative movement that the locking assembly permits or prevents. The locking assembly 22 is selectively movable with respect to a mandrel 100. Mandrel 100 has a groove or grooves 102 as best seen in FIG. 11. A collet ring 104 is seen in section in FIG. 11 and in perspective in FIG. 7. There is a base ring structure 106 that has circumferential wire electrical discharge machining (EDM) cuts 108 and 110 made parallel to each other with a collet head 112 at the free end so that the heads 112 at the end of each finger 114 can flex in a radial direction either toward or away from a corresponding groove 102 in the mandrel 100. There is a leading ramp 114 on each collet head 112 that interacts with ramp 116 on top housing 118 as best seen in FIG. 7. Rotation of mandrel 100 is in tandem with rotation of the lower housing 120 seen in FIG. 6. Ring 104 has alternating peaks 122 and valleys 124 into which the top of the lower housing 120 mesh. Lower housing 120 has a radially biased dog 126 that has end ramps 128 and 130 near the top end 132 as well as opposed side ramp pairs 134 and 136. The biasing is by one or more springs 127 that are between the dog 126 and the sleeve 138 that supports dog 126. Thus rotational force acting on dog 126 will rotate the lower housing 120 and take with it the ring 104. As a result ramp 114 will ride on ramp 116 and then on the inside diameter 140 of the upper housing 118 so that the heads 112 are radially part within the ring structure 106 and part within groove 102 for the axially locked position of FIG. 9. Either rotating the ring 104 in the opposite direction or further in the same direction will allow the heads 112 to move radially outwardly into an adjacent slot 142 that has the shape of a head 112 allowing the spring in the fingers 114 to snap the heads 112 into slot 142 for the unlocked position. Note that the upper housing 118 and the lower housing 120 are secured together at 142 as seen in FIG. 11 but can relatively rotate about the snap ring 144. Thus with the heads 112 in groove 102 the upper housing 118 and lower housing 120 are in such a position the Smart® Collet cannot find support by alignment of 18 with 20 even if collet 10 snaps into profiles 42 or 44. However, the mandrel 100 with the housings 118 and 120 can still move relative to the outer assembly 50 so that the profiles in FIG. 10 that are part of the outer assembly come into play.

Figure 8:
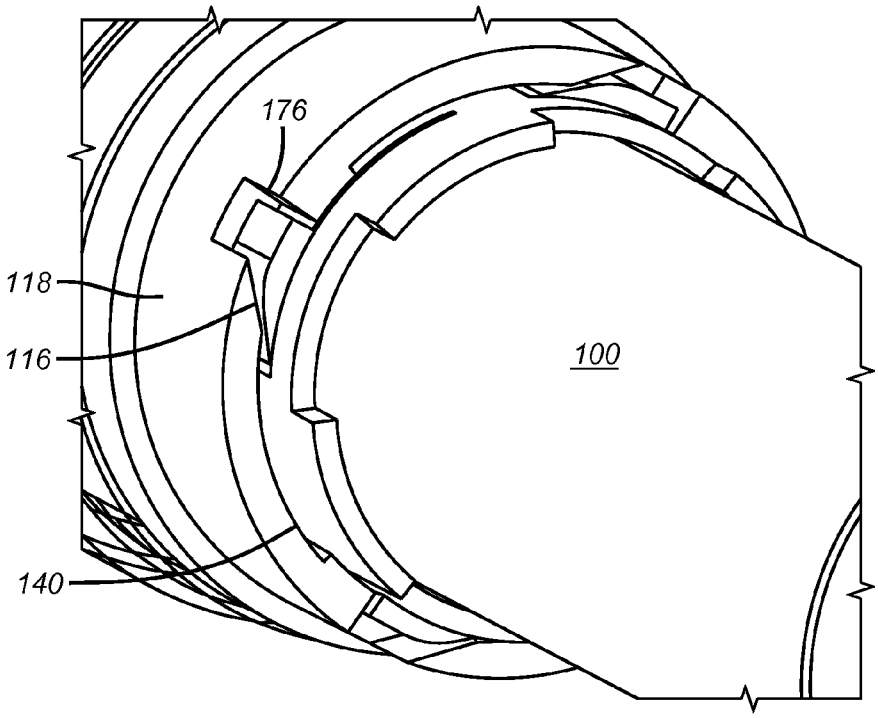
FIG. 8 is a perspective view of the collet type lock ring in the unlocked position.
Figure 9:
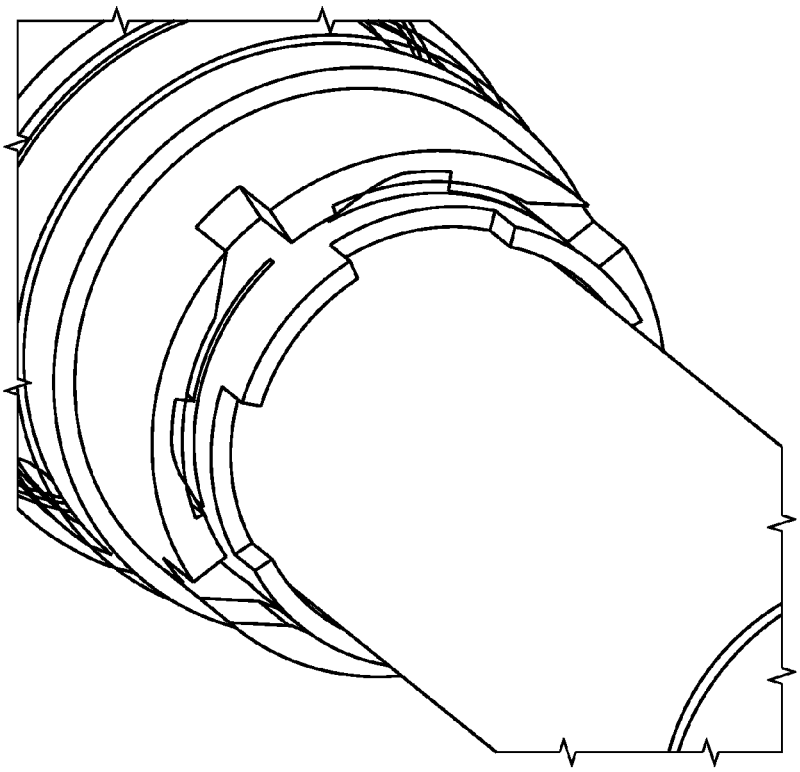
FIG. 9 is the view of FIG. 8 with the collet type lock ring in the locked position.
Figure 10:
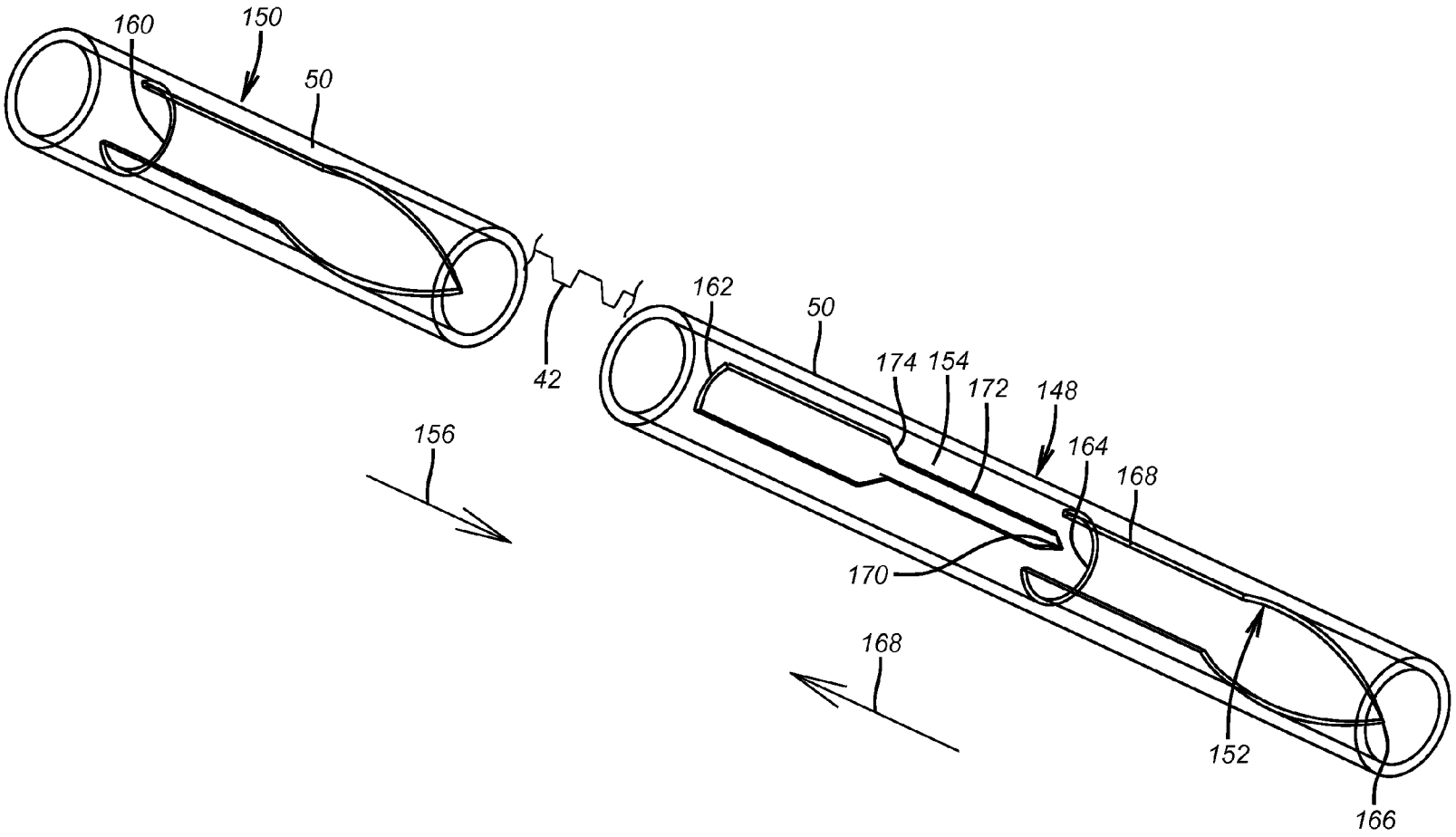
FIG. 10 is an interior view of a part of the outer housing adjacent an associated landing location for a Smart® Collet that selectively allows unlocking and relocking.
Figure 11:
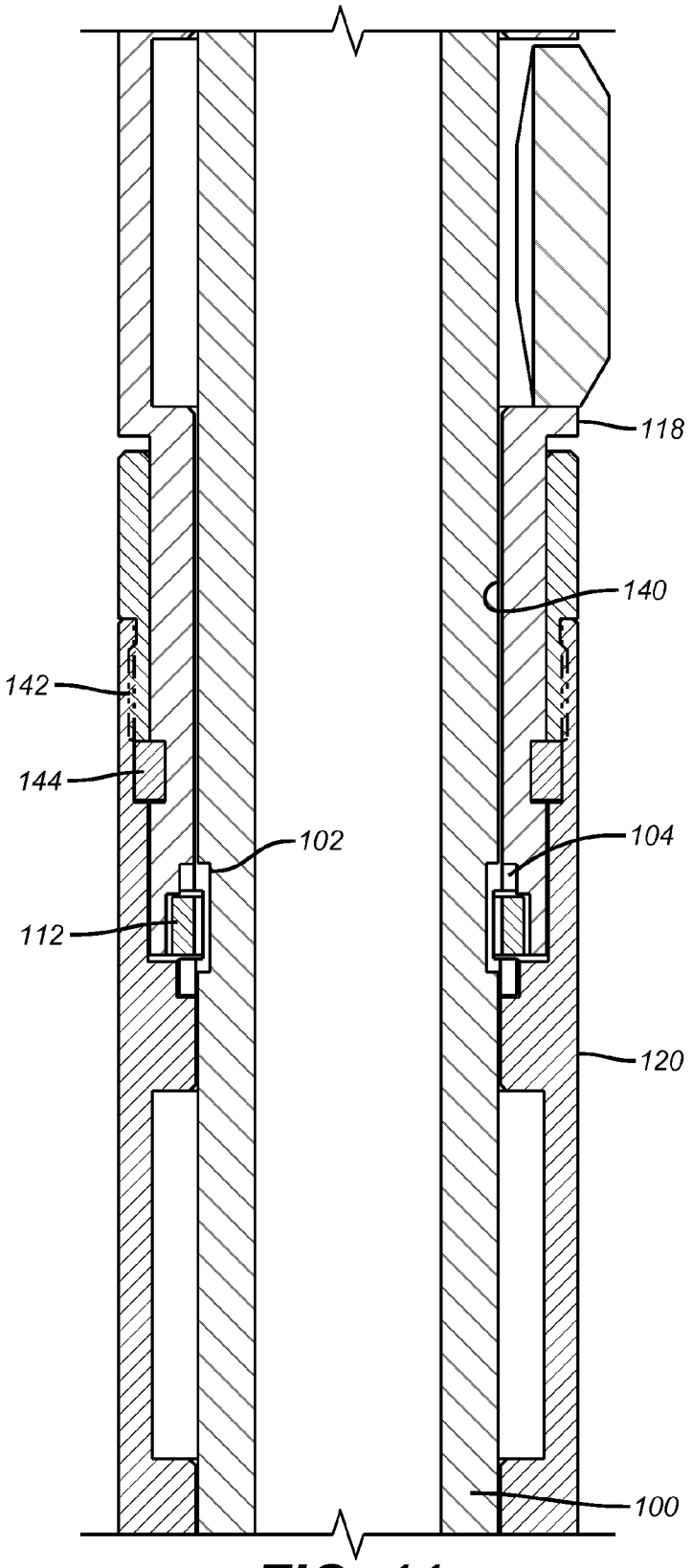
FIG. 11 is a section view showing the unlocked position of the collet type lock ring with respect to an adjacent mandrel groove.

FIG. 10 shows one way to rotate heads 112 between the locked position of FIG. 9 and the unlocked position of FIG. 8. Again, in the unlocked position mandrel 100 can move enough to align 18 with 20 so that the collet 10 can find support in a profile such as 42 or 44. In the locked position of FIGS. 9 18 and 20 can't align so that the collet 10 just snaps in and right out of profiles such as 42 and 44. In either case, the mandrel 110 can move axially with housings 118 and 120 so that dogs 126 and 146 can interact with internal profiles 148 and 150 that are part of the outer assembly 50. Profile 148 has two components 152 and 154 that interact with dogs 126 and 146.

Mandrel 100 movement in the direction of arrow 156 acts only to compress the dogs 126 and 146 radially inwardly against an opposing spring bias from internal springs to those dogs that are not shown. In essence the top tapers 128 and 158 of dogs 126 and 146 respectively facilitate the radially inward movement of both dogs past blunt surface transitions 160, 162 and 164. Whether the tool was locked as in FIG. 9 or unlocked as in FIG. 8 does not change with movement of dogs 126 and 146 in the direction of arrow 156. After dog 146 passes lower point 166 and snaps radially out the movement of the mandrel 100 is reversed to the direction of arrow 168. As movement continues the dog 146 is pushed left or right by point 166. Further movement in the direction of arrow 168 by the mandrel 100 brings dog 146 into wide slot 168 as dog 126 reaches the point 166 and is deflected left or right into alignment with wide slot 168. At point 170 the dog 146 will be on one side of point 170 and dog 126 will be on the other side of the barrier 172. Then ramp 174 relatively rotates the dogs 126 and 146 so that the unlocked orientation of FIG. 8 is accomplished. At that point the collet 10 can find profile such as 42 and lock to it as 18 lines up with 20. When the operation there is completed the mandrel 100 can be further picked up and the direction of relative rotation that unlocked is reversed so that the locked position of FIG. 9 is assumed. After that the collet 10 can be safely moved to the next profile where another structure such as FIG. 10 is to be found and movement through profiles 152 and then 154 will again resume the unlocked position of FIG. 8 so that the collet 10 can be landed and supported in the normal manner.

Those skilled in the art will appreciate that there are variations that could be employed in the number of mandrel grooves 102 and collets oriented circumferentially on the ring 104 for engagement. Movement between the locked and unlocked positions can be with rotation in a single direction or rotation in equal measure in opposed directions. The profiles in FIG. 10 induce relative rotation between the lower housing 120 and ring 104 on one hand and the upper housing 118 on the other hand so that the circumferentially oriented heads 112 get pushed into the grooves 102 for the locked position while reverse relative rotation allows the heads 112 to snap out into grooves 176 as shown in FIG. 8 for the unlocked position. While the preferred application is for a collet such as 10 the described locking and unlocking mechanism can be used in a variety of downhole applications where certain relative movements are to be prevented at a desired time and then subsequently enabled. In the preferred embodiment the locked position of FIG. 9 interacts with the Smart® Collet components to prevent aligning 18 with 20 so that the collet 10 can be supported. In the unlocked position of FIG. 8 different mandrel movement becomes possible and the collet 10 can be supported with 18 aligning with 20 to selectively lock the collet 10 in the known manner.

Those skilled in the art will appreciate that the invention seeks to keep a tool in a locked position when being moved past areas where premature operation is not desirable. The lock system can unlock and relock to allow normal tool operation in a desired zone while preventing operation for any reason when away from desired zones of operation. It is particularly adept at dealing with multiple completion zones where a crossover has to take several positions in a particular zone to accomplish the circulation, squeeze and/or reverse out positions. Mere axial movement is automatically converted to rotation that selectively locks or unlocks the associated tool, which in the preferred embodiment is the Smart® Collet. The benefit of the present invention is the simplicity and the automatic nature of the operation so that that a problem of the Smart® Collet getting a support where it is not desired are eliminated. In essence the lock assembly 22 in a movement of the inner string with the Smart® Collet respectively enables normal operation and then disables normal operation by locking the collet assembly 10 to the mandrel 12 to prevent unintended operation at anywhere but the intended support locations such as at multiple zones 24 and 26. Those zones can be far apart with several radial surfaces in between where the Smart® Collet could otherwise be engaged to find support for the inner string but for the presence of the lock assembly 22 of the present invention.

The above description is illustrative of the preferred embodiment and many modifications may be made by those skilled in the art without departing from the invention whose scope is to be determined from the literal and equivalent scope of the claims below:

I claim:

1. A lock assembly for a subterranean tool operably positioned in a surrounding tubular, comprising:

a mandrel operatively associated with a subterranean tool such that relative movement or the prevention of relative movement therebetween enables or disables said tool from operating;

a lock assembly supported by said tool and mounted to said mandrel for selective engagement to said mandrel for a locked position for said tool and selective release from said mandrel for the operating position for said tool, said lock assembly comprising housing components whose relative rotation with respect to each other selectively engages and releases said lock assembly with said mandrel;

said relative rotation in a first direction selectively drives at least one collet into an associated groove in said mandrel.

2. A lock assembly for a subterranean tool operably positioned in a surrounding tubular, comprising:

a mandrel operatively associated with a subterranean tool such that relative movement or the prevention of relative movement therebetween enables or disables said tool from operating;

a lock assembly supported by said tool and mounted to said mandrel for selective engagement to said mandrel for a locked position for said tool and selective release from said mandrel for the operating position for said tool, said lock assembly comprising housing components whose relative rotation with respect to each other selectively engages and releases said lock assembly with said mandrel;

said relative rotation is in opposed directions responsive to mandrel axial movement in opposed directions.

3. The assembly of claim 1, wherein:

relative rotation in a second direction opposite said first direction aligns a recess of one of said housing components over said collet to allow said collet to exit said groove.

4. The assembly of claim 3, wherein:

said collet is configured with a bias to move out of said groove.

5. A lock assembly for a subterranean tool operably positioned in a surrounding tubular, comprising:

a mandrel operatively associated with a subterranean tool such that relative movement or the prevention of relative movement therebetween enables or disables said tool from operating;

a lock assembly supported by said tool and mounted to said mandrel for selective engagement to said mandrel for a locked position for said tool and selective release from said mandrel for the operating position for said tool, said lock assembly comprising housing components whose relative rotation with respect to each other selectively engages and releases said lock assembly with said mandrel;

said relative rotation in a first direction selectively drives at least one collet into an associated groove in said mandrel;

said collet is ramped into said groove by a stationary upper housing of said housing components.

6. The assembly of claim 5, wherein:

said collet extends circumferentially, in a transverse plane to a longitudinal axis of said mandrel, from a ring that rotates with a lower housing of said housing components.

7. The assembly of claim 6, wherein:

said upper and lower housings further comprise an upper dog and a lower dog respectively, said dogs biased in a direction away from said longitudinal axis of said mandrel.

8. The assembly of claim 7, further comprising:

profile assemblies on the surrounding tubular that interact with said dogs in a manner to create said relative rotation between said upper and lower housing components.

9. The assembly of claim 8, wherein:

said profile assemblies comprise discrete spaced profiles with each profile having a blunt upper end such that movement of said dogs in a downhole direction over said blunt ends retracts said dogs against the bias acting on said dogs without causing relative rotation of said upper and lower housings.

10. The assembly of claim 8, wherein:

said profile assemblies straddle at least one location where said tool is to be operated with an upper profile assembly and a lower profile assembly.

11. The assembly of claim 10, wherein:

movement of said dogs past said lower profile assembly to the location where the tool is to be operated releases said collet from said groove in said mandrel.

12. The assembly of claim 11, wherein:

further movement of said dogs away from said lower profile assembly and toward said upper profile assembly after operation of said tool engages said collet in said groove to allow mandrel movement with said tool locked against actuation.

13. The assembly of claim 12, wherein:

said lower profile assembly comprises a first lower profile with tapered guide surfaces to orient said upper and lower dogs with an elongated slot;

said elongated slot aligns with a second lower profile comprising a longitudinal component positioned so that said upper and lower dogs advance on opposed sides thereof;

said longitudinal component comprising a taper that causes relative rotation between said dogs moving said dogs apart for removal of said collet from said groove in said mandrel.

14. The assembly of claim 13, wherein:

said upper profile comprises tapered guide surfaces to orient said upper and lower dogs with a second elongated slot and creating relative rotation as said dogs are brought together circumferentially to pass through said second elongated slot to move said collet into said groove in said mandrel, thereby allowing further transport of said tool in said locked position of said tool.

15. A lock assembly for a subterranean tool operably positioned in a surrounding tubular, comprising:

a mandrel operatively associated with a subterranean tool such that relative movement or the prevention of relative movement therebetween enables or disables said tool from operating;

a lock assembly supported by said tool and mounted to said mandrel for selective engagement to said mandrel for a locked position for said tool and selective release from said mandrel for the operating position for said tool, said lock assembly comprising housing components whose relative rotation with respect to each other selectively engages and releases said lock assembly with said mandrel;

said relative rotation in a first direction selectively drives at least one collet into an associated groove in said mandrel;

said at least one collet comprises a plurality of collets integrally formed using spaced parallel cuts in a ring in a plane substantially perpendicular to an axis of said mandrel;

said mandrel comprising an associated groove for each said collets;

said housing components comprising an upper and lower housing components;

said collets comprising ramped heads that selectively engage corresponding upper housing ramps for selective movement into a respective said groove.

16. The assembly of claim 15, wherein:

said ring moves in tandem with said lower housing component in response to interaction of a lower housing biased dog with a profile assembly on the surrounding tubular;

said upper housing comprising an upper housing spring loaded dog;

said profile assembly moving said dogs circumferentially apart and subsequently circumferentially together as said mandrel is moved in a single axial direction.

17. A lock assembly for a subterranean tool operably positioned in a surrounding tubular, comprising:

a mandrel operatively associated with a subterranean tool such that relative movement or the prevention of relative movement therebetween enables or and disables said tool from operating;

a lock assembly supported by said tool and mounted to said mandrel for selective engagement to said mandrel for a locked position for said tool and selective release from said mandrel for the operating position for said tool, said lock assembly comprising housing components whose relative rotation with respect to each other selectively engages and releases said lock assembly with said mandrel;

profile assemblies on the surrounding tubular that interact with said housing components in a manner to create said relative rotation therebetween.

18. The assembly of claim 17, further comprising:

said profile assembly moving said housing components relatively rotationally in a first direction and subsequently relatively rotationally in an opposite direction to said first direction as said mandrel is moved in a single axial direction.

* * * * *